United States Patent [19]

Schultz

[11] Patent Number: 4,850,491

[45] Date of Patent: Jul. 25, 1989

[54] APPARATUS FOR CONTROL OF A WOODEN ARTICLE

[75] Inventor: Gert Schultz, Hillerod, Denmark

[73] Assignee: Stormax International A/S, Herlev, Denmark

[21] Appl. No.: 150,414

[22] PCT Filed: May 21, 1987

[86] PCT No.: PCT/DK87/00059

§ 371 Date: Mar. 16, 1988

§ 102(e) Date: Mar. 16, 1988

[87] PCT Pub. No.: WO87/07188

PCT Pub. Date: Dec. 3, 1987

[30] Foreign Application Priority Data

May 30, 1986 [DK] Denmark ..... 2560/86

[51] Int. Cl.[4] ..... B07C 5/14; B07C 5/00; B07C 5/342

[52] U.S. Cl. ..... 209/521; 209/556; 209/581; 209/585; 209/586; 209/587; 209/939

[58] Field of Search ..... 209/518, 521, 555, 556, 209/580, 581, 585, 586, 587, 939; 33/169 R, 172 E, 147 L; 250/223 R; 356/381, 386, 376

[56] References Cited

U.S. PATENT DOCUMENTS

| | | | |
|---|---|---|---|
| 3,341,010 | 10/1961 | Switzer | 209/111.5 |
| 3,554,249 | 4/1968 | Arnelo | 144/312 |
| 3,956,629 | 6/1975 | Gomm et al. | 250/223 R |
| 4,147,619 | 4/1979 | Wassmer et al. | 209/580 |
| 4,443,946 | 4/1984 | McMurty | 33/172 E |
| 4,515,275 | 5/1985 | Mills et al. | 209/580 |
| 4,553,332 | 11/1985 | Golinelli et al. | 33/172 E |
| 4,576,482 | 3/1986 | Pryor | 209/586 |

FOREIGN PATENT DOCUMENTS

| | | | |
|---|---|---|---|
| 1814038 | 12/1968 | Fed. Rep. of Germany . | |
| 2239036 | 8/1972 | Fed. Rep. of Germany . | |
| 2637331 | 8/1976 | Fed. Rep. of Germany . | |
| 3047343 | 12/1980 | Fed. Rep. of Germany . | |
| 59540 | 11/1975 | Finland . | |
| 52433 | 12/1975 | Finland . | |
| 67043 | 8/1979 | Finland . | |
| 64300 | 3/1981 | Finland . | |
| 64301 | 3/1981 | Finland . | |
| 2528972 | 12/1983 | France | 209/586 |
| 8606305 | 11/1986 | PCT Int'l Appl. | 209/556 |
| 600301 | 12/1977 | Switzerland . | |
| 2046428 | 11/1980 | United Kingdom | 209/587 |
| 2152658 | 8/1985 | United Kingdom | 209/576 |

*Primary Examiner*—Joseph J. Rolla
*Assistant Examiner*—Steve Reiss
*Attorney, Agent, or Firm*—Pollock, Vande Sande & Priddy

[57] ABSTRACT

Optical fibers control the height and curvture on the perpendicular level of a number of articles on a conveyor while the articles traverse a box in which the optical fibers are placed so that the light ray is disturbed in response to the height and curvature of the articles. Outside the box the articles are scanned by a camera. Both from the box and from the camera (11) measuring data are transferred to a computer (13) which evaluates the measured data and decides whether or not the article is to be discarded when it reaches the grading device. In this way a reliable, three-dimensional control of the articles is achieved.

9 Claims, 5 Drawing Sheets

APPARATUS FOR CONTROL OF A WOODEN ARTICLE

TECHNICAL FIELD

The present invention relates to an apparatus for control of an article, preferably a wooden article, said apparatus comprising a conveyor with measuring and control devices for control measuring of the article and a grading device adapted to remove discarded articles.

BACKGROUND ART

When manufacturing wooden articles, such as ice lollies and chopsticks, it is essential to remove defective articles no matter whether the defect is due to the stick being lopsided, having knots, having the wrong dimensions or being discolored.

The object of the present invention is to provide an apparatus which at a great speed, corresponding to the speed of manufacture of the article in question, can perform an effective control so that the approved manufactured goods are usable and appear uniform and preferably comely.

According to the invention the apparatus of the above stated type is characterised by the control devices comprising at least one first set of optical fibers situated opposite to each other on each side of the conveyor and at a predetermined height whereby the optical fibers on one side are adapted to emit a light ray along and parallel with the surface of the article, and whereby the optical fibers on the other side are adapted to receive the emitted light ray. The latter fibers are connected to a light sensitive detector adapted to provide a signal to a microprocessor. At least a second set of optical fibers is placed at mutually different heights close to the upper edge of a reflective plate member being elevationally slidable in response to the thickness (height) of the article. The optical fibers are adapted to emit and receive an optionally reflected light ray. The mutual, elevational location of said optical fiber is arranged so that an article being too high causes a reflection of more than a predetermined number of the second set of optical fibers, and an article being too low causes a reflection of less than a predetermined number of the light-rays emitted from the second set of optical fibers. The optical fibers of the second set of optical fibres are connected to light sensitive detectors adapted to receive the reflected light rays and depending thereon to provide signals to the microprocessor. One or more screen scanning camera(s) are mounted so that the conveyor and a number of articles thereon can be scanned from above and/or from below. The control device further includes devices for activating the screen scanning camera in response to the speed of the conveyor and preferably each time an article passes. The screen scanning camera is adapted to provide electric signals, representing one or more pictures of the scanned area. The picture signals are transferred to the microprocessor, which is adapted to process and evaluate the picture signals in order to determine width, curvature in the horizontal plane and length of each article and to compare these quantities with predetermined values, and based on this comparison, the microprocessor whether or not the article is to be discarded and provides corresponding impulses to the grading device.

In this way an unusually fast and effective grading of the articles is achieved. The first set of optical fibres grades articles curving in the perpendicular plane as such curvatures cause the article to block a light ray which can only pass if the article is linear and not too thick. The second set of optical fibres grades articles which are to high or too low, and such second set of optical fibres is preferably placed on each side of the conveyor so that both ends of the article are measured. By means of the camera and the associated microprocessor all dimensions in the horizontal plane can be controlled. By means of the suggested apparatus a very fast control in all three dimensions of a spatial article is achieved. The apparatus is particularly suitable for flat, oblong articles, such as ice lollies and chopsticks.

The width is preferably determined locally at intervals along the article. The article is preferably divided into a number of transverse sections and an average width for each section can be determined. The curvature is preferably measured in the horizontal plane as an aberration from a predetermined straight line. By the described apparatus it is possible to control the color of the article. According to the invention, the microprocessor is adapted to determine the total color level of the article by summing up the light intensity over the entire article.

Local color variations can advantageously be determined by summing up the light intensity in a number of limited areas and determining optional variations.

Small local areas having a particularly low light intensity are preferably registered. In this way it is possible to ascertain whether or not the article is knotty. According to the invention, predetermined acceptable values can be recorded in the microprocessor in order to compare the same with the data achieved by control of the articles. Such data are preferably recorded in the microprocessor during a learning phase by sending a number of first-grading-articles through the apparatus, which then measures and registers the characteristics of the articles. Such learning-articles are to be selected so that they only fulfil the desired margins defined by these articles to the microprocessor. Preferably the apparatus is adapted to receive an alternative set of margin-values corresponding to a second-grading of the articles.

BRIEF DESCRIPTION OF THE DRAWING

The invention is explained in the following with reference to the accompanying drawing, in which.

DESCRIPTION OF THE PREFERRED EMBODIMENTS OF THE INVENTION

Figure 1:
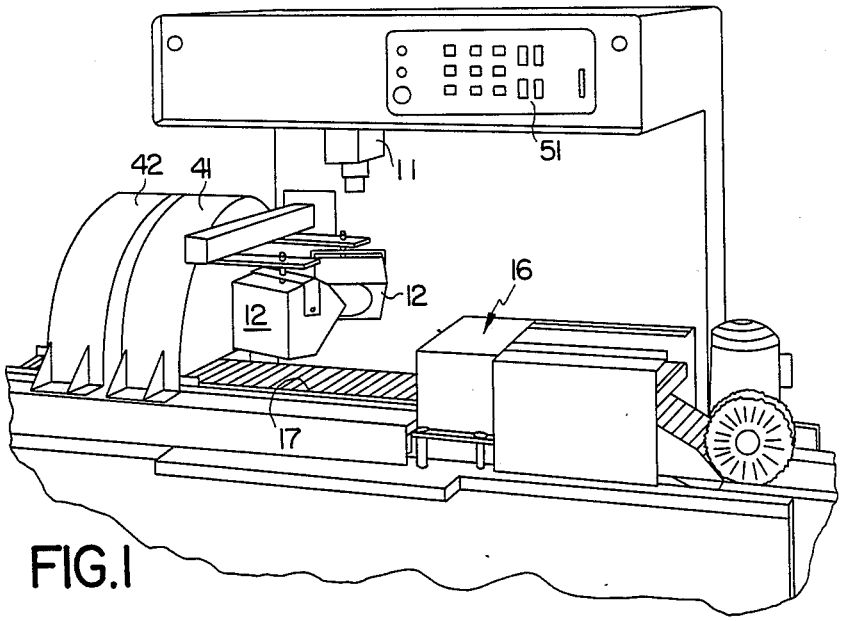
FIG. 1 shows an example of an embodiment of an inventive apparatus.
Figure 2:
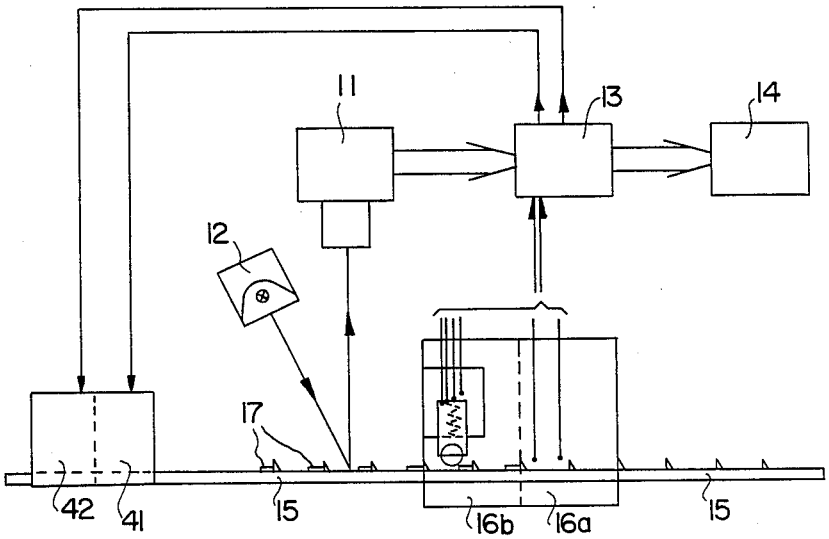
FIG. 2 is a block diagram corresponding to the apparatus of FIG. 1.

An example of an embodiment of an apparatus according to the invention is shown in FIGS. 1 and 2. On a chain conveyor 15 a number of oblong articles 17 are advanced. In the present case each article consists of two chopsticks sticking together at their thick ends. In the first control station 16, the articles are evaluated with respect to curvature and thickness (height) in the vertical direction.

In the first half 16*a* of the control station, see FIG. 3, the article just passes below a light ray if it is rectilinear and not too high. The light ray is emitted from an optical fiber 18 and passes across the conveyor belt along the surface of the article to a receiving optical fiber 19 on the other side of the conveyor. If the article curves too much or is too high, this light ray is blocked. Such blocking is detected by an appropriate light sensitive circuit which may be of known art, and information on the approval or disapproval of the article is sent to a microprocessor 13.

The control station comprises preferably two such curvature controls 18, 18', 19, 19', of which one is adjusted to approve first-grading articles while the second is adjusted to approve second-grading articles.

Figure 3:
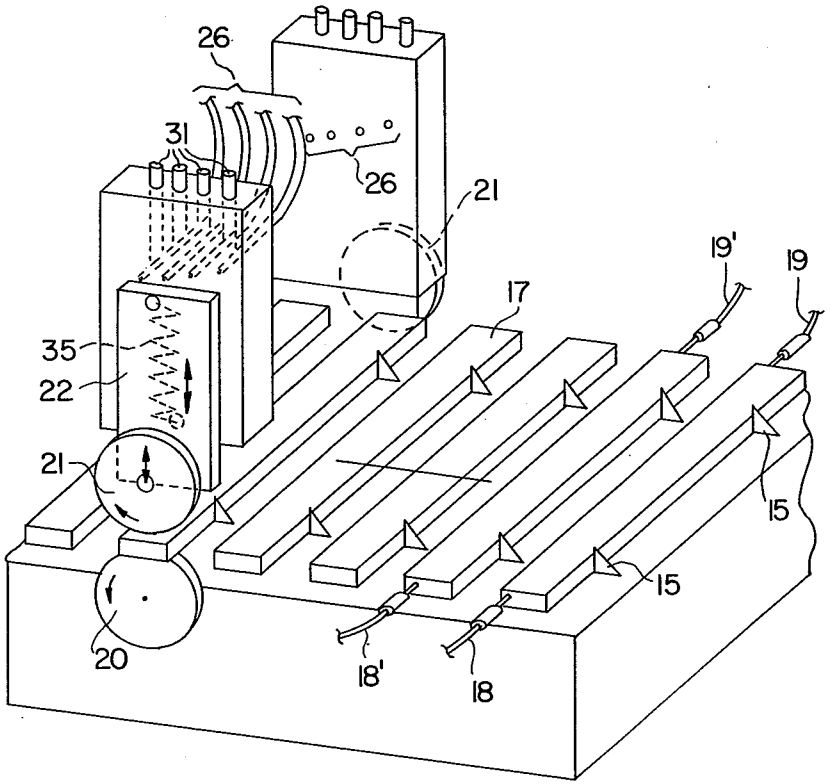
FIG. 3 is a section of the apparatus of FIG. 1 on a larger scale and without shielding.

In the last half of the control station 16 a thickness control 16*b*, which is also shown in greater detail in FIG. 3 is provided. The chain conveyor guides the article in between two pairs of rollers 20, 21, mounted on each side, and of which the lower rollers are fixed while the upper rollers are pressed upwards by the article to a level depending on the thickness of the article; for the sake of lucidity, only one pair of rollers has been shown. The upper roller is mounted on a perpendicularly displacable plate or wing 22, which is pulled downwards towards the article by a spring 35. The upper edge of the plate can be made to cover a number of optical fibers 26, connected to opto-reflectors which partly emit a light ray and partly register whether or not this light ray is reflected. If the article is too thick, the plate is lifted so high that the shiny, i.e. reflective, plate covers all optical fibers and thus reflects all the rays of light. The reflection is registered by light sensitive detectors and information thereof is transferred to the microprocessor 13. Preferably four measuring points are used, i.e. preferable four optical fibres 26 are mounted. The fiber ends facing the reflective plate are in close proximity to the upper edge of the plate, yet at slightly different heights, so that a first-grading article would cause the reflective plate to cover only two of the optical fibers while allowing the other two fibers to radiate freely; whereas a second-grading article, being a little thicker, causes the reflective plate to cover three optical fibers and let one radiate freely. And a second-grading article, being a little too thin, causes the reflective plate to cover only one optical fiber and let the other three radiate freely. In the preferred embodiment, the perpendicular positions of the optical fibers 26 are adjustable from above by means of adjusting screws 31.

When the article has passed the control station 16, the chain conveyor continues to transport the article under a camera 11 which is scanning the chain conveyor and the articles thereon. Two lamps 12 illuminate the articles concurrently with the scanning. The camera 11 is a screen scanning camera and the picture information registered therein is transferred optionally to a not shown data screen and, particularly, to a computer which compares and evaluates the picture information with predetermined data. Based on this comparison, impulses are provided to the grading devices 41, 42. Grading device 41 all articles which are to be discarded; whereas the device 42 grades second-grading sticks so that only first-grading sticks continue on the conveyor for further processing.

The impulses to the grading device 41, 42 are provided by the microprocessor with such a time delay that the article, having been measured by the control station, reaches the grading station together with its corresponding grading impulse. Such a time delay can be provided e.g. in connection with the data processing in the microprocessor by storing the grading bits, 0 or 1, in a shift register wherein one location is provided for each article-point on the conveyor, from the first measuring point of the control station to the grading station, so that the location for the grading bit in question in the shift register is shifted simultaneously with the moving of the article on the conveyor. The microprocessor, after a check of the calculation, would place the result on the correct location in the shift register so that the article in question would reach the grading station at the same time as the corresponding grading bit reaches an output from the shift register.

Figure 4:
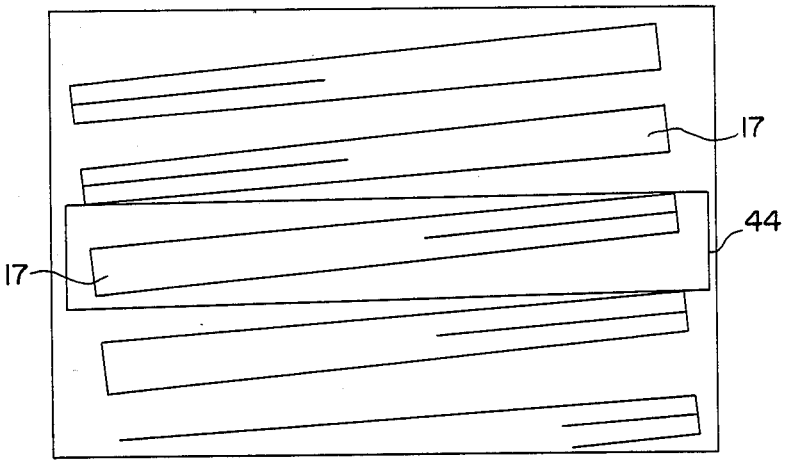
FIG. 4 is a first screen picture.

The camera 11 scans the conveyor with articles, c.f. FIG. 4. The microprocessor 13 evaluates the pictures one by one; and if a data screen 14 is connected, the control may be followed on a screen picture as shown in FIG. 4. In said Fig., the article to be controlled is framed in a frame 44. On basis of the picture the geometric measurements shown in FIGS. 6–9 are performed. Each measurement is compared to previously stored predetermined desired data. If it turns out that the article does not fulfill the allowable tolerances, an impulse is provided to the subsequent grading device. Preferably the latter grading device comprises a blow nozzle. In the apparatus of FIG. 1, said nozzle is arranged to blow the discarded article away from the conveyor. As appears from FIG. 4, the apparatus is adapted to be able to control sticks oriented in both directions.

Preferably the microprocessor is adapted to initially control whether or not the articles fulfil a set of second-grading tolerance values, which are manually adjustable by means of thumb wheels 51 of FIG. 1. If they do not, the microprocessor would store and later provide an impulse to a first blow nozzle mounted at the first grading station 41 grading discarded articles. If the article falls within said tolerance zone, the microprocessor would evaluate whether the articles fulfils the tolerances given by the first-grading articles; and if this is not the case, an impulse is stored and given to a second blow nozzle 42 in a subsequent grading station thus removing second-grading articles from the conveyor.

As shown in FIG. 4, the camera has been turned a few degrees, e.g. 5°, in relation to the articles so that the scanning lines of the camera do not merge with the longitudinal limits of the article.

As appears from FIGS. 6–9, the microprocessor performs a number of calculations on the geometry of the article. In accordance with specified tolerances, demands are made on correct width, which is measured at intervals of about 3 mm, and correct average width. The calculations are performed by dividing the article into a number of transverse sections, preferably six, whereby each section must show a correct average width. Furthermore, the curvature of the article is determined, as the article is supposed to be limited by straight lines. Also, the length is determined, preferably by measurements on each side of the separation line for separating the article into two chopsticks.

Apart from the geometry it is also desirable that the article presents itself with a uniform color effect so that discolored sticks and sticks with knots are discarded. This is achieved by measuring and summing the light intensity over the entire picture of the stick and comparing the result with a predetermined value. Local color variations which may be due to local discolorings can be determined by measuring changes in the light intensity in small limited areas. The circuits can advantageously be adapted to divide the article into small sections, sum the light intensity for the individual sections and make a comparison.

Finally, knots can be registered by examining whether small areas having a particularly low light intensity exist, as knots are normally dark and therefore reflect less light.

The predetermined values—which constitute the standard of comparison when the microprocessor is to evaluate whether or not the registered measurements are to be approved of—are provided preferably in the form of a learning phase which includes setting the apparatus and thus the microprocessor to a learning condition. Thereafter a number of first grading articles, of varying quality, some of which are almost second grading, are conveyed through the apparatus and measured and scanned as explained above. The articles chosen for the learning define the limits between first. Therefore, second grading and the articles chosen for the learning should comprise all variants allowable among the first-grading articles. During learning, the apparatus measures and registers all the above parameters for width, length, curvature in the horizontal plane and total color and color variations.

The set of tolerances for second-grading articles set by means of the thumb wheels 51 comprises preferably the following: (a) the point by point measurements of the average width, (b) the curvature in the horizontal plane, (c) the length, and (d) color level, color variation and knots.

Figure 5:
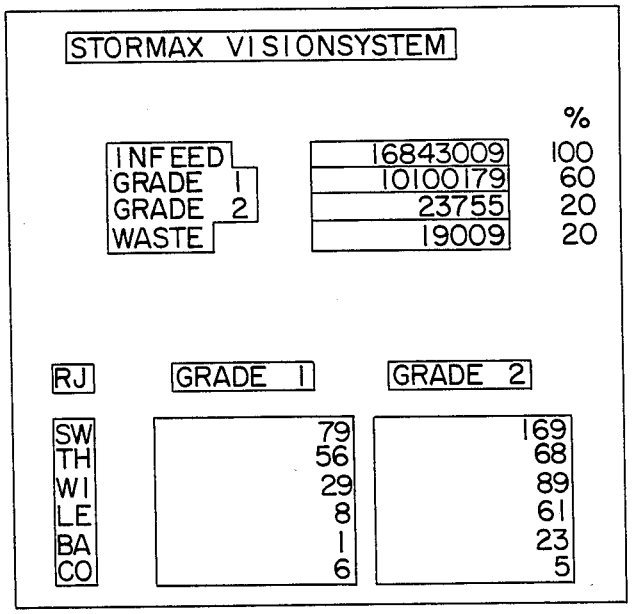
FIG. 5 is a second screen picture.
Figure 6:
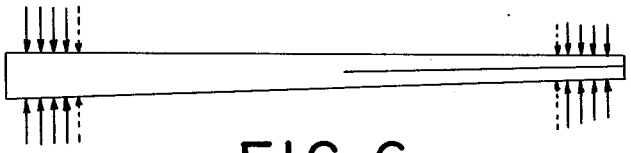
FIG. 6 is an example of measurement of local width.
Figure 7:
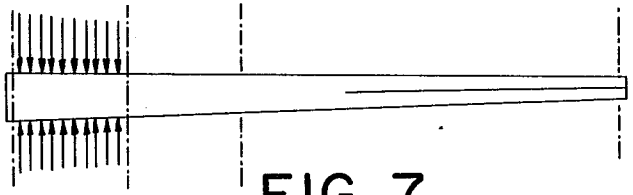
FIG. 7 is an example of measurement of an average width.
Figure 8:
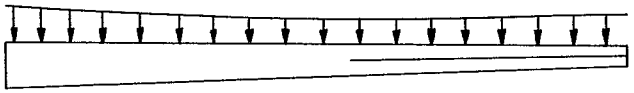
FIG. 8 is an example of measurement of curvature.
Figure 9:
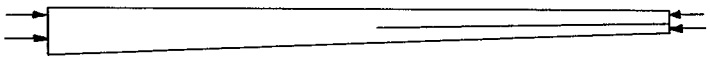
FIG. 9 is an example of measurement of length.
Figure 10:
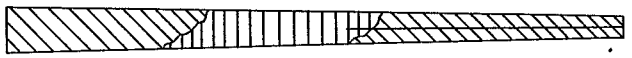
FIGS. 10, 11 and 12 are examples of different shades of the article.
Figure 11:
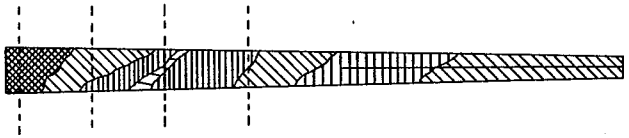
Figure 12:
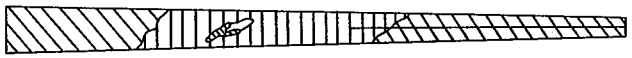

In a preferred embodiment the microprocessor is adapted to show how many articles have been discarded and the reasons therefor. After the control of a production series, this may be done by means of a screen picture as shown in FIG. 5.

Preferably the microprocessor is adapted to determine an "idling"-color level and a high intensity in between the articles, ie. adapted to measure the gaps between the articles. Such a measurement is used to correct for variations in the luminous intensity of the lamps, e.g. because of the aging of the bulbs. A control circuit is provided for indicating when a bulb is to be replaced by lighting a warning lamp.

The apparatus described allows a very fast grading of articles on basis of a large number of complex measurings and thus ensures a suitable quality of the approved articles.

The programming of the microprocessor is not being described more fully as it may be done by a person skilled in the art in numerous ways.

I claim:

1. An apparatus for control of an article, said apparatus comprising a conveyor, measuring and control devices for control of the dimensions of the article and a grading device for removing discarded articles, wherein the measuring and control devices comprise:

at least one first set of optical fibers situated opposite to each other on each side of the conveyor and at a predetermined height, the optical fibers on one side of the conveyor being connected at their far ends to a light source for emitting light rays across the conveyor along and parallel with the upper surface at least one of the articles carried on and positioned transversely of the conveyor, and the optical fibers on the other side of the conveyor receiving the emitted light rays not obstructed by the article, the latter fibers being connected to a light sensitive detector for providing a signal indicative of whether or not the light rays are obstructed by the article to a microprocessor;

at least one second set of optical fibers placed at mutually different heights close to the upper edge of a vertically displaceable reflective plate device supported on means superposed over the articles being carried on the conveyor, said superposed means vertically movable in response to the height of each of the articles being carried on the conveyor to vertically displace the reflective plate relative to the second set of optical fibers, said second set of optical fibers emitting light rays and receiving reflected light rays according to the height of each of the articles, the mutually vertical position of said optical fibers being arranged so that an article, being too high, would cause a reflection of more than a predetermined number of the light rays emitted from the second set of optical fibers, and an article, being too low, would cause a reflection of less than a predetermined number of the light rays emitted from the second set of optical fibers, and wherein each optical fiber is connected to a light sensitive detector further connected to the microprocessor to receive the corresponding reflected light ray and, accordingly providing a signal to the microprocessor;

at least one screen scanning camera mounted proximately to the conveyor for scanning the conveyor and a number of articles thereon, the camera being connected to an input of the microprocessor to provide picture signals corresponding to one or more pictures of the scanned article to the microprocessor, the microprocessor processing and evaluating the picture signals in order to determine width, curvature and length of each article and to compare these quantities with predetermined values; and based on this comparison, the microprocessor further deciding whether or not the article is to be discarded and providing corresponding impulses to the grading device.

2. An apparatus as claimed in claim 1, wherein the microprocessor determines the width at a predetermined number of measurement locations, the intervals of the measurement locations being substantially constant.

3. An apparatus as claimed in claim 2, wherein the microprocessor programming includes a routine to measure the length on each side of a lengthwise center line corresponding to the separation line between two partly interconnected articles.

4. An apparatus as claimed in claim 1, wherein the microprocessor divides the stored picture signals of each of the articles into a number of transverse sections and determines an average width of each section during the processing of the picture signals.

5. An apparatus as claimed in claim 1, wherein the microprocessor programming includes a routine to determine the curvature of the article in the horizontal plane by measuring the aberration of one edge from a predetermined straight line.

6. An apparatus as claimed in claim 5, wherein the microprocessor further determines a total color level by summing light intensities over the entire article.

7. An apparatus as claimed in claim 6, wherein the microprocessor determines local color variations by summing the light intensity in small limited areas and comparing the summed light intensities.

8. An apparatus as claimed in claim 1, wherein the microprocessor detects small local sectors having a particularly low light intensity.

9. An apparatus as claimed in claim 1, wherein the microprocessor programming includes a routine to operate a learning phase, in which phase data for articles to be accepted are recorded in the microprocessor by placing on the conveyor a number of first-grading-articles barely fulfilling the demands on first-grading and letting these articles pass the apparatus, the microprocessor further processing and evaluating the picture signals to determine a color level of each article, and wherein the microprocessor is programmed to register all necessary data for said articles, the data including widths, length, color level and variations.

* * * * *